US009326579B2

(12) United States Patent
Steiner

(10) Patent No.: US 9,326,579 B2
(45) Date of Patent: May 3, 2016

(54) COMB FOR LICE OR OTHER PARASITIC INSECTS

(71) Applicant: Patricia E. Steiner, Redondo Beach, CA (US)

(72) Inventor: Patricia E. Steiner, Redondo Beach, CA (US)

( * ) Notice: Subject to any disclaimer, the term of this patent is extended or adjusted under 35 U.S.C. 154(b) by 0 days.

(21) Appl. No.: 14/631,151

(22) Filed: Feb. 25, 2015

(65) Prior Publication Data

US 2015/0164197 A1 Jun. 18, 2015

Related U.S. Application Data

(63) Continuation of application No. 14/058,057, filed on Oct. 18, 2013, now Pat. No. 8,967,157.

(60) Provisional application No. 61/716,329, filed on Oct. 19, 2012.

(51) Int. Cl.
*A45D 24/00* (2006.01)
*A45D 24/30* (2006.01)

(52) U.S. Cl.
CPC ..... *A45D 24/30* (2013.01)

(58) Field of Classification Search
CPC ..... A45D 24/00; A45D 24/04; A45D 24/10; A45D 24/30
See application file for complete search history.

(56) References Cited

U.S. PATENT DOCUMENTS

| | | | | |
|---|---|---|---|---|
| 6,158,443 | A * | 12/2000 | Leman et al. | 132/120 |
| 6,691,713 | B1 | 2/2004 | Altschuler | |
| 8,104,485 | B2 | 1/2012 | Maor et al. | |
| 8,276,595 | B2 | 10/2012 | Maor et al. | |
| 8,511,321 | B2 | 8/2013 | Sanz et al. | |
| 2001/0037772 | A1 * | 11/2001 | Huddleston | 119/626 |

* cited by examiner

*Primary Examiner* — Rachel Steitz
(74) *Attorney, Agent, or Firm* — Knobbe, Martens, Olson & Bear, LLP

(57) ABSTRACT

A lice, flea or other parasitic insect comb has a handle that extends over top of the metal teeth of the comb and is shaped to be comfortable in the hand. The handle can comprise a U-shaped portion having a hand grip portion and a pair of spaced-apart struts that extend between the hand grip portion and the metal teeth of the comb. Preferably, the hand grip portion is spaced from a plane containing or aligned with the metal teeth and is vertically aligned with the metal teeth of the comb. Such a handle configuration can facilitate positioning of the teeth of the comb substantially flat against or parallel to the scalp, which makes removal of lice and nits more effective. In some configurations, the comb teeth can be wider than standard lice combs, so it covers more hair and therefore takes less time to remove nits and lice.

20 Claims, 7 Drawing Sheets

COMB FOR LICE OR OTHER PARASITIC INSECTS

INCORPORATION BY REFERENCE TO RELATED APPLICATIONS

Any and all applications identified in a priority claim in the Application Data Sheet, or any correction thereto, are hereby incorporated by reference herein and made a part of the present disclosure.

BACKGROUND

1. Field

The disclosure generally relates to removal or treatment products for parasitic insects, such as lice or fleas. In particular, the disclosure relates to lice or flea combs.

2. Description of Related Art

Lice has become an epidemic worldwide and so far, there is no solution in site as more and more parents are discovering the resistance to many lice treatment shampoos or other topical products. For years, removing lice and nits from hair has been a tedious, ongoing, old fashioned process that can take hours and hours. In this day and age, time to do this is a rare commodity. There are plenty of lice combs, lice zapping gadgets, lice repellants etc. that claim to remove lice and nits. Although many will remove lice, most are not sufficient to remove nits or they can take hours to remove the parasite from heads. Furthermore, when children have lice, adults living in that household will likely be infected too. If nits are not removed, within 2-3 weeks or so, the child and the rest of the family are again infested with lice because the nits hatch and lice spreads from head to head again. Lice are most often recycled because the child or other family members have been treated inadequately. The situation is similar for fleas.

SUMMARY OF THE INVENTION

The systems, methods and devices described herein have innovative aspects, no single one of which is indispensable or solely responsible for their desirable attributes. Without limiting the scope of the claims, some of the advantageous features will now be summarized.

An embodiment involves a lice comb having a teeth unit and a handle. The teeth unit comprises a plurality of closely-spaced comb teeth suitable for use in combing a user's hair for lice or nits. The handle is coupled to the teeth unit and comprises a hand grip portion that is spaced from a plane that contains the teeth unit.

In some configurations, at least a portion of the hand grip portion is vertically aligned with at least a portion of the teeth unit.

In some configurations, the handle is generally U-shaped.

In some configurations, the handle comprises a connection portion coupled to the teeth unit and a pair of struts supporting the hand grip portion relative to the connection portion.

In some configurations, the hand grip portion is generally or substantially parallel with the connection portion.

In some configurations, the hand grip portion is positioned rearward of a forward-most end of the teeth unit.

In some configurations, the hand grip portion is generally cylindrical in shape and sized to allow a user to completely surround the hand grip portion in a circumferential direction when grasping the comb.

BRIEF DESCRIPTION OF THE DRAWINGS

Throughout the drawings, reference numbers can be reused to indicate general correspondence between reference elements. The drawings are provided to illustrate example embodiments described herein and are not intended to limit the scope of the disclosure.

DETAILED DESCRIPTION

Figure 2:
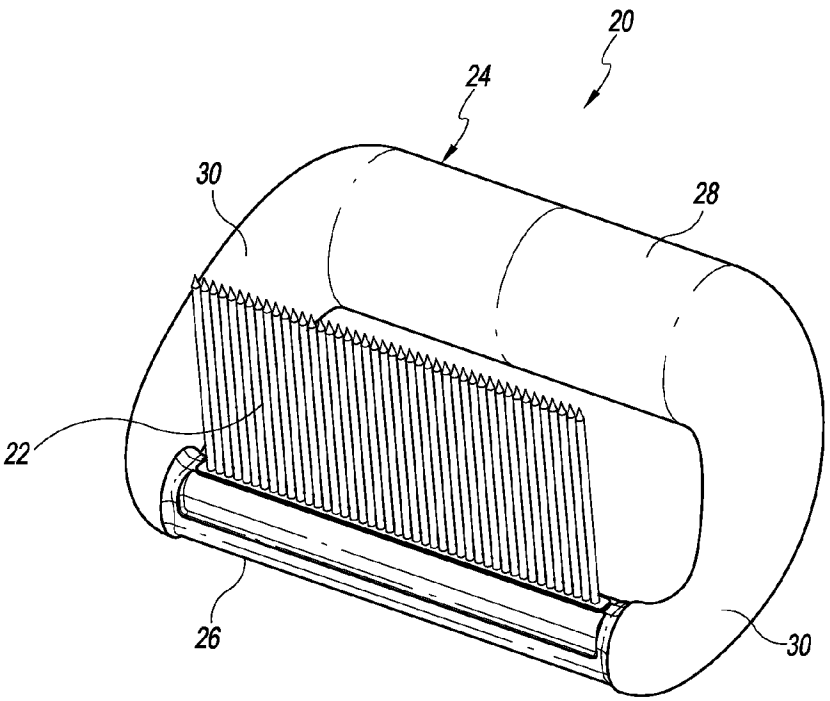
FIG. 2 is another perspective view of the comb of FIG. 1.
Figure 1:
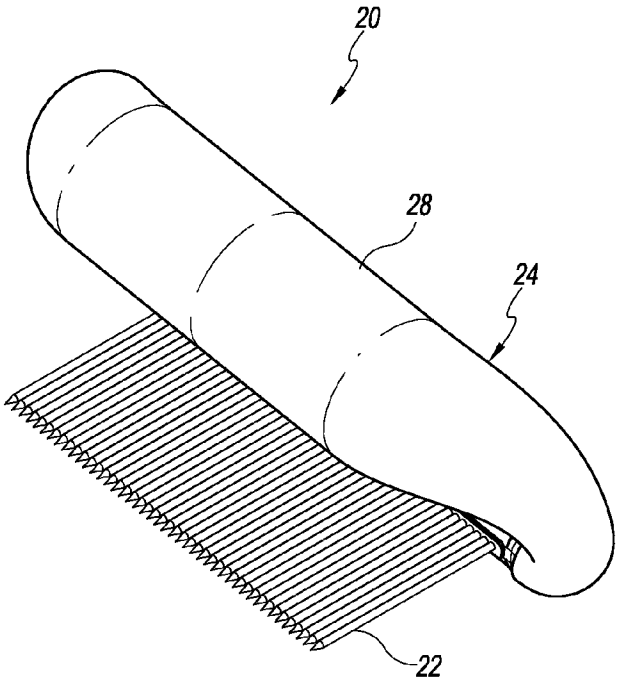
FIG. 1 is a perspective view of a comb for parasitic insects having certain features, aspects and advantages of a preferred embodiment.
Figure 4:
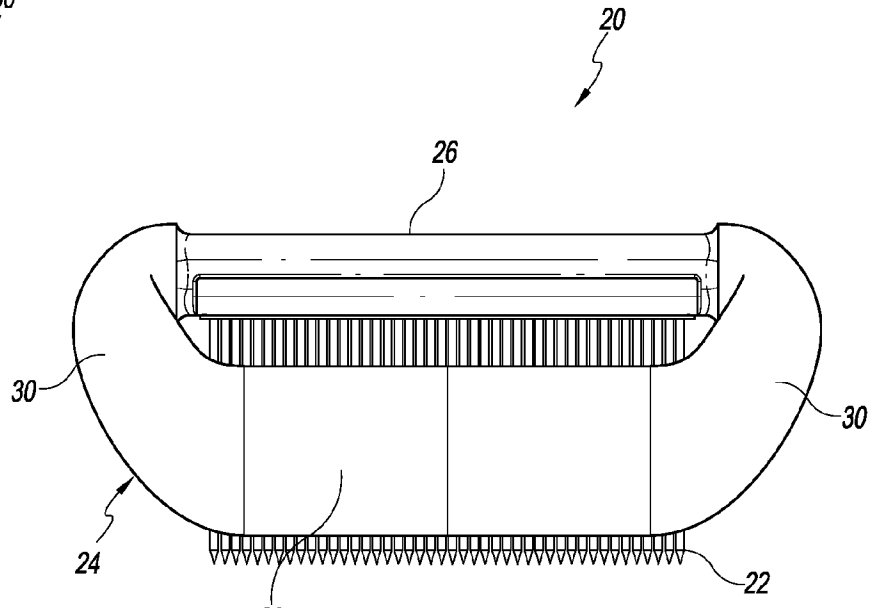
FIG. 4 is a top view of the comb of FIG. 1.
Figure 3:
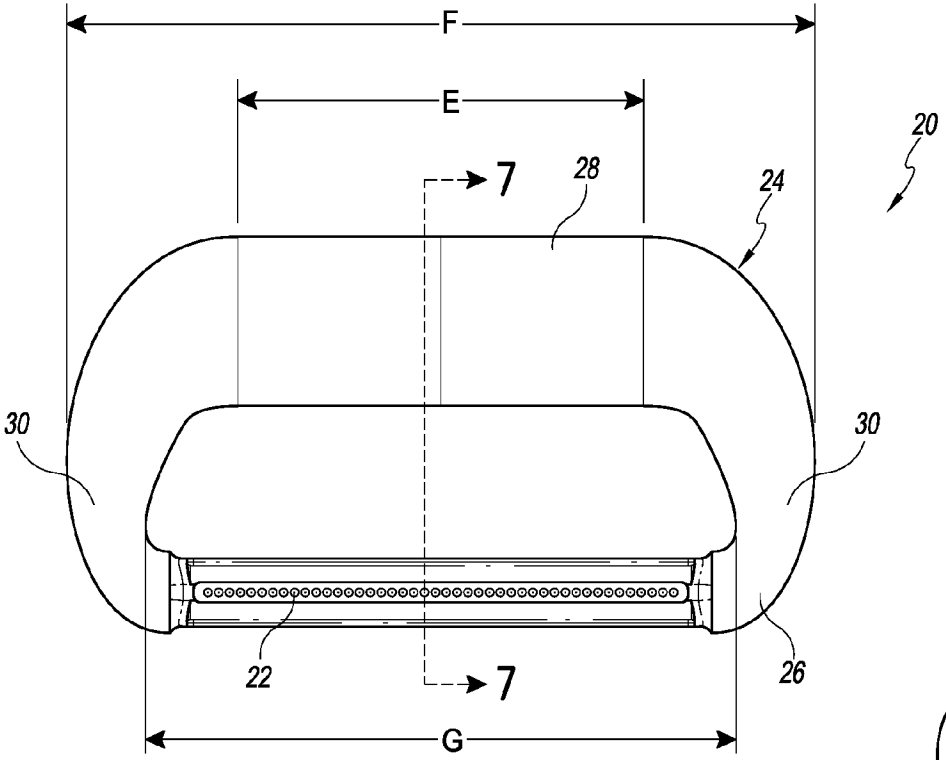
FIG. 3 is a front view of the comb of FIG. 1. The rear view of the comb is the same except the comb teeth are not visible.
Figure 5:
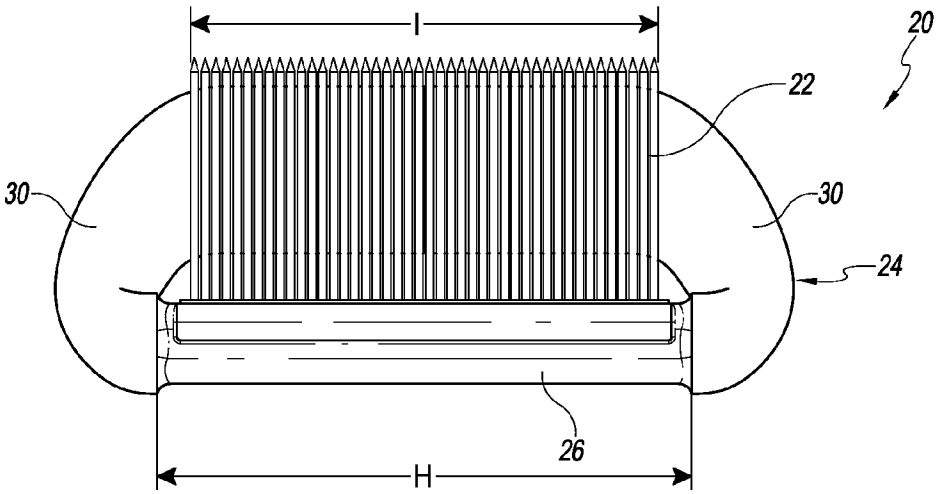
FIG. 5 is a bottom view of the comb of FIG. 1.
Figure 6:
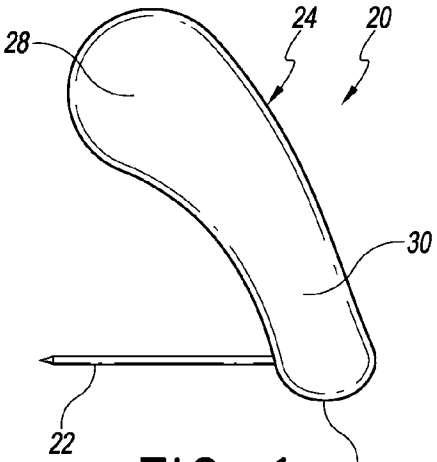
FIG. 6 is a right side view of the comb of FIG. 1. The left side view is a mirror image of the right side view.
Figure 7:
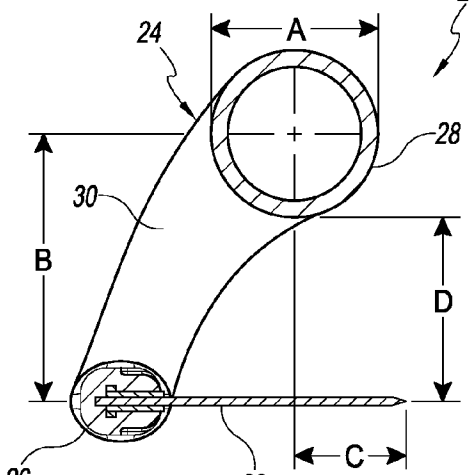
FIG. 7 is a sectional view of the comb of FIG. 1.
Figure 9:
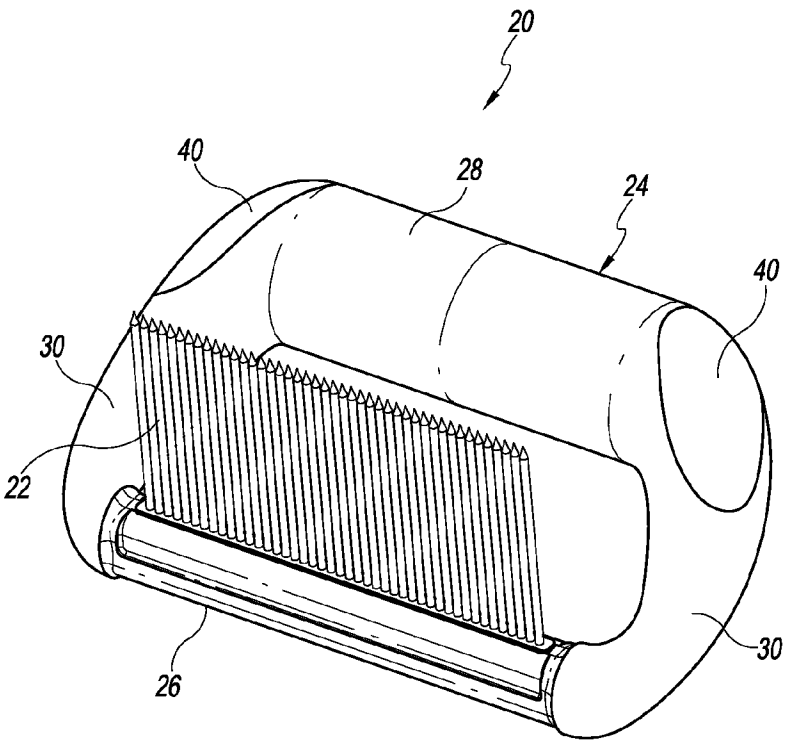
FIG. 9 is another perspective view of the comb of FIG. 8.
Figure 8:
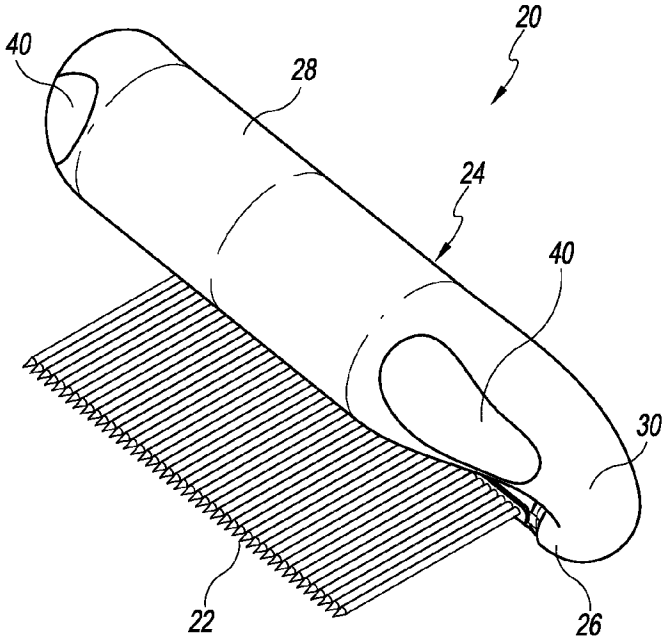
FIG. 8 is a perspective view of a comb for parasitic insects having certain features, aspects and advantages of a preferred embodiment.
Figure 11:
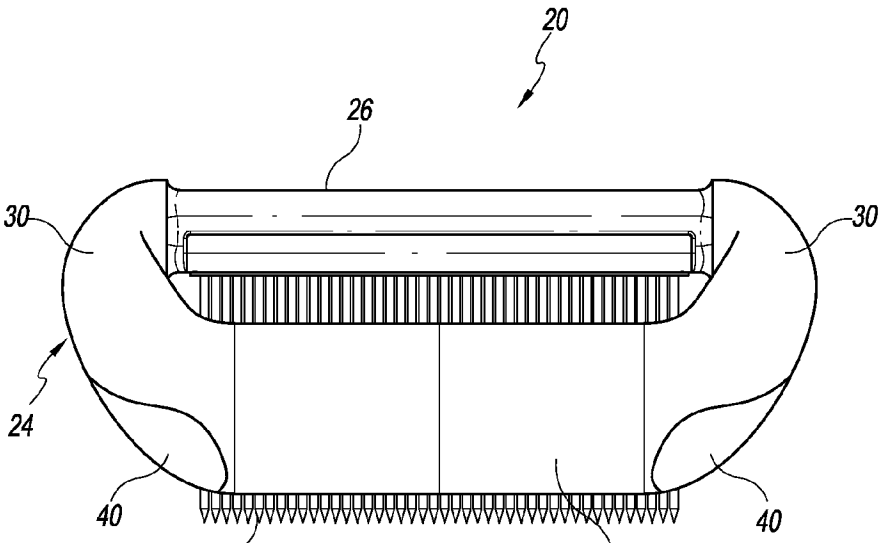
FIG. 11 is a top view of the comb of FIG. 8.
Figure 10:
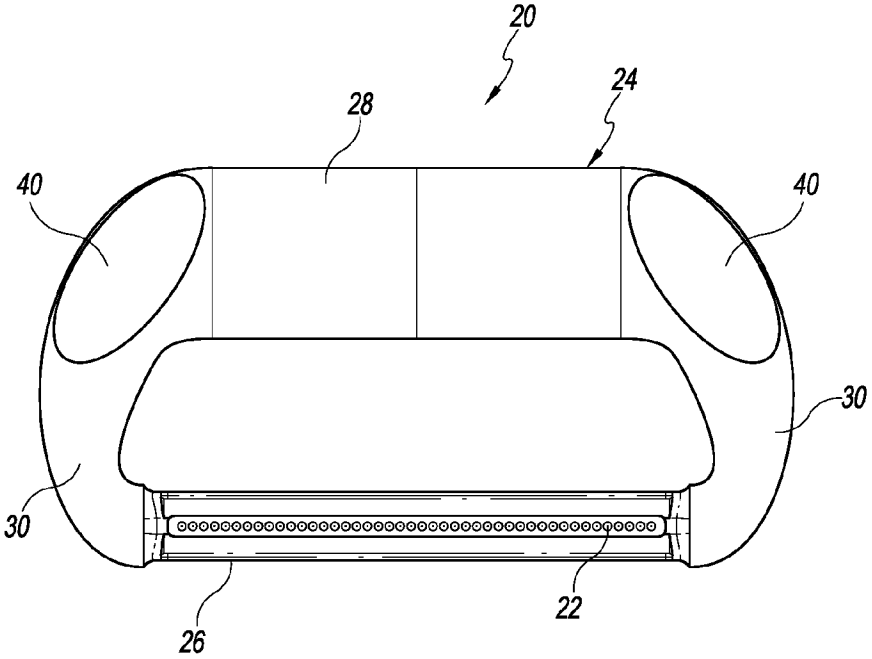
FIG. 10 is a front view of the comb of FIG. 8. The rear view of the comb is the same except the comb teeth are not visible.
Figure 13:
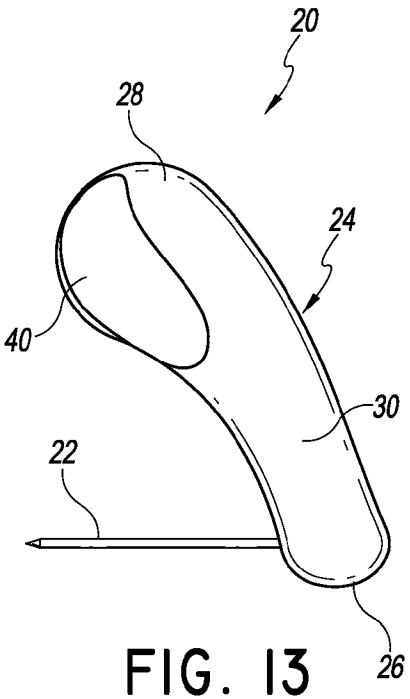
FIG. 13 is a right side view of the comb of FIG. 8. The left side view is a mirror image of the right side view.
Figure 12:
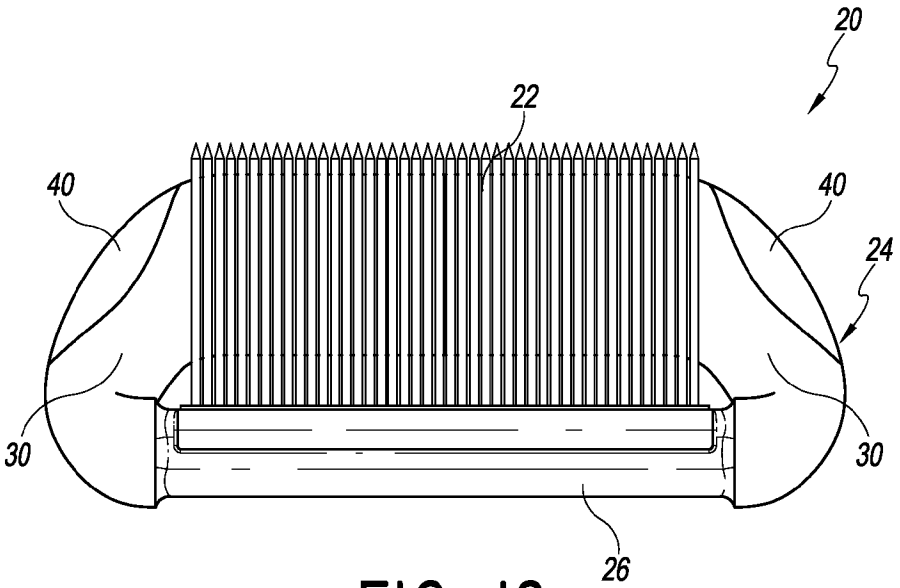
FIG. 12 is a bottom view of the comb of FIG. 8.

An aspect of the present invention involves the realization by the present inventor that because parents removing lice often use a regular lice comb in an incorrect manner because they hold the comb at an incorrect angle, they stand the chance of never ridding hair of these parasites. In at least some embodiments of the comb, the handle design facilitates correct orientation of the teeth or tines of the comb, which is parallel or tangential to the scalp, making the comb effective at removing nits and lice. The handle design can also make the comb easy and/or comfortable to use by providing improved ergonomics relative to a standard lice comb. Moreover, in at least some embodiments, the greater width of the comb teeth relative to standard lice combs increases the effectiveness of the present comb.

One or more embodiments of the present comb are designed to facilitate correct and convenient use of the comb, which is advantageous because prevention or early removal is a key to lice control. Because the preferred embodiments are easy to use as an 'every day' lice comb, it will encourage parents to comb their children's hair on a regular basis, so that an early detection of lice can be discovered before it gets to an infestation. The lice comb can be easily swiped through the hair on a regular basis, after bathing, before school, etc. The easy to use designs of the preferred embodiments will encourage families to detect live lice before they can infest the hair and adults can use the comb on themselves with ease and without help. Because lice is spread head to head, especially in schools, camps, pre-schools, etc., routine combing during the peak outbreaks of lice infestations, such as summertime, summer camps, the weeks following back to school, etc. is encouraged as part of a lice prevention routine to pick up any lice that may have gotten into the hair. Prevention of infestation by combing is a big part of stopping the recycling of lice and as more and more children and families are dealing with lice, the 'prevention combing' will be beneficial, especially if the comb is quick, comfortable and easy to use. There is also the removal of lice on an infested child. The comb is easy and quicker to use as opposed to the standard method, which is to painstakingly remove one nit at a time or section off the hair inch by inch.

Configurations of the lice, flea or other parasitic insect comb can include one or more of the following features, many of which are illustrated in the accompanying drawings. The lice comb can have a handle that extends over the metal teeth and is shaped to be comfortable in the hand. At least a portion of the handle can be positioned over the teeth (i.e., overlap at least a portion of the teeth) of the comb for easier combing, especially when self-combing. When handled, the handle configuration can facilitate positioning of the teeth of the comb in the correct angle for applying to the hair (i.e., generally or substantially flat against or parallel to the scalp), which makes removal of lice and nits more effective. In some configurations, the comb teeth can be wider than standard lice combs, so it covers more hair and therefore takes less time to remove nits and lice. Older, smaller width combs take hours because parents have to comb section by section of hair and pin up each of those sections one by one.

Preferred embodiments of the comb are designed for easier use compared to standard lice combs. The handle size, shape or position makes it less awkward to handle than regular lice combs having a handgrip portion that is substantially aligned in the plane of the teeth. In some configurations, the rounded shape of the handle makes for an easier and more comfortable grip than other lice combs. When combing out lice and nits, the hair preferably is wet and a conditioner be applied to hair so combing is easier and won't pull the hair. In one or more configurations, the grip of the handle will make it less likely to slip out of the hand at least because the handle can have a hand grip portion that can be cylindrical or generally cylindrical in shape, which extends along an axis that is offset and parallel from the plane containing or aligned with the teeth, and permits a user's hand to completely surround and obtain a positive grip on the handle. The term cylindrical is used in its ordinary sense and can cover any closed loop cross-sectional shape (e.g., circular or non-circular) that is extruded to have a length. The offset nature of the grip portion can keep hands spaced from the hair and reduce or eliminate the exposure of the combing hand to the conditioner or other product applied to the hair. Moreover, the handle can include enhanced-grip portions, which can be a different material from adjacent portions of the handle or can have grip-enhancing surface features, for example.

The shape of the handle in preferred embodiments makes it easier for self-use, which is advantageous for adults who come into contact with lice due to the infected children. As lice have become resistant to over-the-counter lice shampoos, regularly combing as a preventative measure is the best way to prevent a lice infestation from happening. Preferred embodiments of the comb are advantageous because they encourage regular use and facilitate quick and convenient use of the comb. In addition, because of the greater lateral length of the teeth, preferred embodiments of the comb provide a quicker method for removing lice and nits because it takes fewer strokes to comb the entire area.

Some configurations include a 'lice catch' that, in some arrangements, can be positioned underneath a magnifier (which can include an optional LED light source) to make it easier to see the lice. In some configurations, the magnifier can be detachable, such as through a clip-on interlocking or any other suitable arrangement.

The handle can be of any suitable shape, such as those illustrated in FIGS. 1-14 or others. With reference to FIGS. 1-7, an embodiment of a parasitic insect comb 20 (generically referred to as a "lice comb" herein) is shown having, generally, a set of comb teeth or tines, or a teeth unit 22, and a handle 24. Preferably, the handle 24 has a mount portion or a connecting portion 26 that is coupled to the teeth unit 22 and extends upwardly (or in a direction away from or having a component perpendicular to a plane that is generally aligned with or contains) the teeth unit 22 to a hand grip portion 28. At least one and preferably a pair of spaced apart struts or support portions 30 extend between, and preferably connect, the connecting portion 26 and the hand grip portion 28. Thus, the portion of the handle 24 that extends away from the teeth unit 22 (and away from the connection portion 26 of the handle 24) can have a generally U-shape with ends that are coupled to opposing rear portions of the teeth unit 22.

Preferably, the handle 24 is inclined relative to a plane that is generally aligned with or contains the teeth unit 22. In some configurations, the handle 24 is inclined at an oblique angle relative to a plane that is generally aligned with or contains the teeth unit 22. In the illustrated arrangement, the handle 24 generally extends in one direction (i.e., forwardly) from rearward edge of the teeth unit 22. However, in other configurations, the handle 24 could initially extend from the connecting portion 26 in one direction (e.g., rearwardly or away from the teeth unit 22) and then extend in a second direction (e.g., forwardly or back towards the teeth unit 22) to the hand grip portion 28. In any event, in one or more configurations, the hand grip portion 28 preferably is located partially or completely over top of (i.e., vertically aligned with) the teeth unit 22 such that a line that is perpendicular to the plane containing or aligned with the teeth unit 22 can pass through both the teeth unit 22 and the hand grip portion 28. Preferably, such a line can pass through both a center point (midpoint or geometric center) of the hand grip portion 28 and the teeth unit 22. In the illustrated arrangement, both the forward-most and rearward-most edges of the hand grip portion 28 are vertically aligned with the teeth unit 22.

The connecting portion 26 and the hand grip portion 28 can extend in a lateral direction between the pair of struts or support portions 30. The connection portion 26 and the hand grip portion 28 can be generally or substantially parallel to one another. The hand grip portion 28 can be positioned forward of the connection portion 26. A portion or an entirety of the hand grip portion 28 can be located behind the forward-most edge (e.g., free or unsupported edge) of the teeth unit 22. Preferably, the hand grip portion 28 is spaced above the teeth unit 22 a sufficient distance to accommodate a user wrapping his or her hand around the hand grip portion 28.

The teeth unit 22 can comprise a single piece that defines multiple teeth or can be multiple individual teeth coupled to the handle 24. Other suitable arrangements can also be used. A single piece is presently preferred for manufacturing purposes. The teeth preferably are tightly spaced in a configuration and with dimensions commonly used and known as suitable for use in a lice comb. However, as described, in at least some embodiments the teeth unit 22 is wider than the set of teeth of a standard lice comb. The surfaces of the teeth can be smooth or serrated. The teeth preferably are generally straight or linear and aligned with one another in a single plane; however, other suitable arrangements can also be used, such as those disclosed in U.S. Pat. Nos. 8,511,321, 8,276,595, 8,104,485 and 6,158,443, for example and without limitation.

The handle 24 can be overmolded onto the teeth unit 22 or the handle and teeth unit can be otherwise coupled in any suitable manner, including with adhesives or through intermediate component(s). The teeth unit 22 can be removable and/or replaceable, such as with a friction fit or snap fit arrangement with the handle 24. The handle 24 and teeth unit 22 can be made of any suitable material or combination of materials. For example, the handle 24 can be constructed of a moldable material, such as plastic or, in particular, polypropylene. The teeth unit 22 preferably is constructed from a stainless steel material; however, other suitable metals, plastics or other materials can be used.

In at least one embodiment, the hand grip portion 28 can have an outer diameter or maximum cross-sectional dimension A of about 25 millimeters (e.g., between about 20 mm and about 30 mm or any value or sub-range within the recited ranges). A center of the hand grip portion 28 can be spaced above the plane of the teeth unit 22 (dimension B) by about 35 millimeters (e.g., between about 25 mm and about 45 mm or any value or sub-range within the recited ranges) and spaced behind a leading, front or free edge of the teeth unit 22 (dimension C) by about 14.5 or 15 millimeters (e.g., between about 10 mm and about 20 mm or any value or sub-range within the recited ranges). A bottom or lowermost surface of the hand grip portion 28 can be spaced above the plane of the teeth unit 22 (dimension D) by about 20, 22.5 or 25 millimeters (e.g., between about 15 mm and about 30 mm or any value or sub-range within the recited ranges). The hand grip portion 28 can have an axial length or handle width E of about 60 millimeters (e.g., between about 50 mm and about 80 mm or any value or sub-range within the recited ranges). An overall width F of the handle 24 can be about 110 millimeters (e.g., between about 90 mm and about 130 mm, between about 100 mm and about 120 mm or any value or sub-range within the recited ranges). A maximum width of an interior space G of the handle 24 (between the inner surfaces of the support portions 30) can be about 86.5 millimeters (e.g., between about 75 mm and about 95 mm or any value or sub-range within the recited ranges). An axial length H or width of the connection portion 26 can be about 80 millimeters (e.g., between about 70 mm and about 90 mm or any value or sub-range within the recited ranges). A lateral width I of the teeth unit 22 can be about 70 millimeters (e.g., between about 50 mm and about 100 mm or any value or sub-range within the recited ranges). An angle of the handle 24 relative to the teeth unit 22 can be between about 30 and about 60 degrees, such as about 45 to about 50 degrees, or about 48 degrees, including any value or sub-range within the recited ranges. Any dimensions used herein are for example only and are not intended to limit the present disclosure. Such dimensions are presently preferred for a lice or flea comb and are configured to accommodate from 0-75% of the female North American hand size. The dimensions can be adjusted to suit other applications or intended users, or for other reasons.

FIGS. 8-13 illustrate a comb 20 that is substantially identical to the comb 20 of FIGS. 1-7; however, the handle 24 of the comb 20 includes one or more enhanced grip portions 40. Preferably, enhance grip portions 40 are provided on each side of the handle 24, such as at each end of the hand grip portion 28. Enhanced grip portions 40 can be provided on one or both of the front side and back side of the hand grip portion 28 or can extend partially or completely around the hand grip portion 28 in a circumferential direction. The enhanced grip portions 40 can be a different material than adjacent portions of the hand grip portion 28 or can be enhanced surface features (e.g., micro textures) or a combination of both, for example.

Figure 14A:
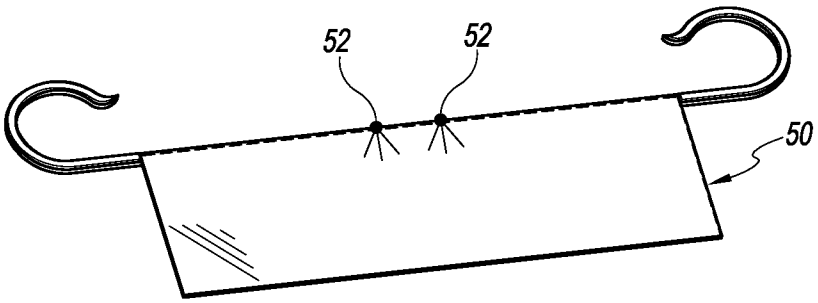
FIGS. 14A and 14B illustrate an accessory for the comb, such as a magnifying lens attachment, shown in a detached state and an attached state, respectively.
Figure 14B:
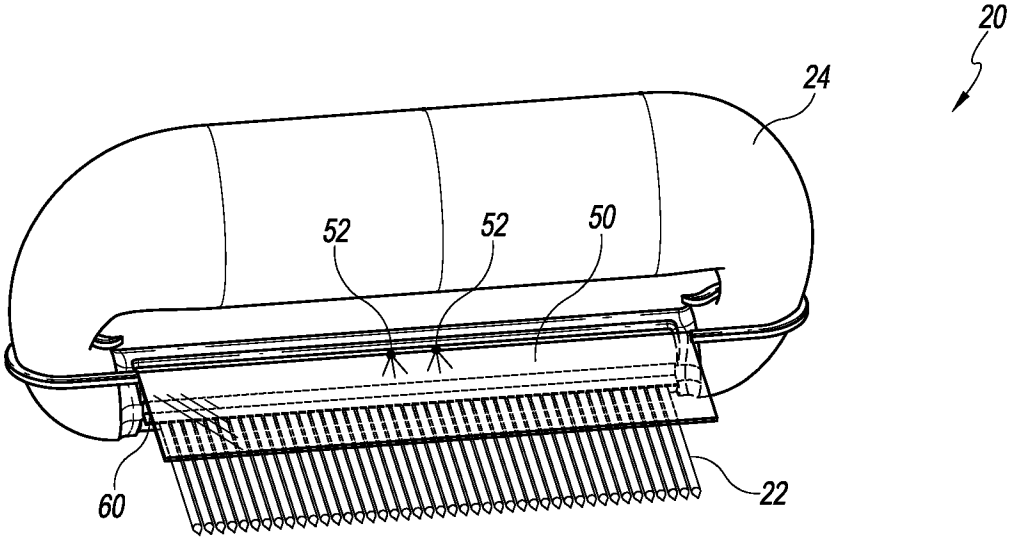

FIGS. 14A and 14B illustrate an accessory separated from the comb (FIG. 14A) and attached to the comb (FIG. 14B). The accessory can include any suitable component or combinations of components. For example, the illustrated arrangement includes a magnifier 50, which can comprise a magnifying lens that extends along a portion or a substantial entirety of a width of the teeth unit 22. The magnifier 50 (or other accessory) can clip onto the handle 24, such as the support portions 30, for example. In other arrangements, the magnifier 50 (or other accessory) can clip onto the connection portion 26, another portion of the handle 24 or another portion of the comb 20, or can otherwise be (preferably removably) attachable to the comb 20.

The magnifier 50 can optionally include a light source 52, such as one or more LED lights, for example. A power source (not shown) can be provided on the magnifier 50 or on the comb 20 and can be connected to and power the light source. In addition, an optional lice catch 60 can be coupled to the comb 20 in an identical or similar manner to the magnifier 50 at or near a rearward (supported) edge of the teeth unit 22. The lice catch 60 can be of any suitable construction to function as a receptacle for lice or other parasitic insects that are picked up by the teeth unit 22, such as a trough or basin arrangement, for example.

Although described in the context of a lice comb, embodiments of the present disclosure can also find utility in other applications, or be modified for other applications. For example, the comb can be used as a flea comb to extract fleas from the fur of animals, such as dogs or cats, for example. In some cases, it may be desirable to scale up or down some or all portions of the comb to better suit a specific application. For example, a width and/or length of the teeth unit 22 may be scaled down for use with small dogs or cats. The width and/or length of the teeth unit 22 may be scaled up for use with large dogs or other large animals. In general, the size of the handle 24 will be based on the intended user of the comb 20, rather than the intended use.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims that follow.

What is claimed is:

1. A lice comb, comprising:

a planar teeth unit comprising a plurality of closely-spaced comb teeth suitable for use in combing a user's hair for lice or nits, the teeth unit having an upper surface defined by a length direction and a width direction of the teeth unit, the length direction extending along the length of the comb teeth and the width direction extending across the plurality of comb teeth, the teeth unit having a thickness equal to a thickness of the comb teeth;

a handle coupled to the teeth unit and comprising a hand grip portion that is spaced above the upper surface of the teeth unit, wherein an axis of the handgrip portion is located above the upper surface of the teeth unit by a distance measured along a line that extends in a perpendicular direction relative to the upper surface of the teeth unit;

wherein an entirety of the comb teeth of the teeth unit are arranged in a single row.

2. The lice comb of claim 1, wherein at least a portion of the hand grip portion is vertically aligned with at least a portion of the teeth unit such that the line that extends in a perpendicular direction relative to the upper surface of the teeth unit can pass through both the handgrip portion and the teeth unit.

3. The lice comb of claim 2, wherein the line that extends in a perpendicular direction relative to the upper surface of the teeth unit can pass through both the axis of the handgrip portion and the teeth unit.

4. The lice comb of claim 3, wherein one or both of a forward-most and rearward-most edges of the handgrip portion are vertically-aligned with the teeth unit.

5. The lice comb of claim 1, wherein the handle is generally U-shaped.

6. The lice comb of claim 5, wherein the handle comprises a connection portion coupled to the teeth unit and a pair of struts supporting the hand grip portion relative to the connection portion.

7. The lice comb of claim 6, wherein the hand grip portion is generally or substantially parallel with the connection portion.

8. The lice comb of claim 1, wherein the hand grip portion is positioned rearward of a forward-most end of the teeth unit.

9. The lice comb of claim 1, wherein the hand grip portion is generally cylindrical in shape and sized to allow a user to completely surround the hand grip portion in a circumferential direction when grasping the comb.

10. The lice comb of claim 1, wherein the teeth unit comprises a single piece that defines the plurality of comb teeth.

11. The lice comb of claim 1, wherein the handle is overmolded onto the teeth unit.

12. The lice comb of claim 1, wherein the teeth unit is removable or replaceable relative to the handle.

13. The lice comb of claim 1, wherein the distance between the axis of the handgrip portion and the upper surface of the teeth unit measured along the line that extends in a perpendicular direction relative to the upper surface of the teeth unit is between about 25 mm and about 45 mm.

14. The lice comb of claim 13, wherein the distance is about 35 mm.

15. The lice comb of claim 14, wherein a bottom surface of the hand grip portion can be spaced from the upper surface of the teeth unit about 15 mm to about 30 mm along the line that extends in a perpendicular direction relative to the upper surface of the teeth unit.

16. The lice comb of claim 1, wherein a bottom surface of the hand grip portion can be spaced from the upper surface of the teeth unit about 15 mm to about 30 mm along the line that extends in a perpendicular direction relative to the upper surface of the teeth unit.

17. The lice comb of claim 1, wherein a lateral width of the handgrip portion is between about 75 mm and about 95 mm.

18. The lice comb of claim 1, wherein the handle comprises one or more enhanced grip portions comprising a different material than adjacent portions of the handle or grip-enhancing surface features.

19. The lice comb of claim 1, further comprising a magnifying lens attached to the comb above the teeth unit.

20. The lice comb of claim 1, further comprising a receptacle attached to the comb at or near a rearward edge of the teeth unit for collecting lice or other insects picked up by the teeth unit.

* * * * *